US006978235B1

(12) United States Patent
Ozawa

(10) Patent No.: US 6,978,235 B1
(45) Date of Patent: Dec. 20, 2005

(54) SPEECH CODING APPARATUS AND SPEECH DECODING APPARATUS

(75) Inventor: Kazunori Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/302,397

(22) Filed: Apr. 30, 1999

(30) Foreign Application Priority Data

May 11, 1998 (JP) ..... 10-145087

(51) Int. Cl.[7] ..... G10L 19/10; G10L 19/12
(52) U.S. Cl. ..... 704/219; 704/220; 704/223
(58) Field of Search ..... 704/219, 220, 704/223

(56) References Cited

U.S. PATENT DOCUMENTS

| | | | | |
|---|---|---|---|---|
| 5,444,816 | A * | 8/1995 | Adoul et al. | 704/219 |
| 5,596,676 | A | 1/1997 | Swaminathan et al. | |
| 5,623,575 | A | 4/1997 | Fette et al. | |
| 5,657,418 | A * | 8/1997 | Gerson et al. | 704/207 |
| 5,701,392 | A * | 12/1997 | Adoul et al. | 704/219 |
| 5,704,003 | A * | 12/1997 | Kleijn et al. | 704/220 |
| 5,729,655 | A | 3/1998 | Kolesnik et al. | |
| 5,751,903 | A * | 5/1998 | Swaminathan et al. | 704/230 |
| 5,754,976 | A * | 5/1998 | Adoul et al. | 704/223 |

FOREIGN PATENT DOCUMENTS

| | | |
|---|---|---|
| JP | HEI 4-171500 | 6/1992 |
| JP | HEI 4-363000 | 12/1992 |
| JP | HEI 5-6199 | 1/1993 |
| JP | HEI 6-222797 | 8/1994 |
| JP | HEI 9-90995 | 4/1997 |

OTHER PUBLICATIONS

Ozawa et al, "M-LCELP Speech Coding at 4KBPS", Acoustics, Speech, and Signal Processing, 1994. ICASSP-94, 1994 IEEE International Conference on, vol.: 1, Apr. 19-22, 1994, Page(s): I/269-I/272 vol. 1.*

Ojala, P., "Toll Quality Variable-Rate Speech Codec," *IEEE*,, pp. 747-750, Apr. 21, 1997.

Chan, C. F., "Multi-Band Excitation Coding of Speech at 960 BPS Using Split Residual VQ and V/UV Decision Regeneration," *ICSLP 94*, vol. 4, pp. 2083-2086, Sep., 1994.

(Continued)

*Primary Examiner*—Angela A. Armstrong
(74) *Attorney, Agent, or Firm*—Whitham, Curtis & Christofferson, PC

(57) ABSTRACT

A speech coding apparatus includes a spectrum parameter calculation section, an adaptive codebook section, a sound source quantization section, a discrimination section, and a multiplexer section. The spectrum parameter calculation section receives a speech signal and quantizes a spectrum parameter. The adaptive codebook section obtains a delay and a gain from a past quantized sound source signal using an adaptive codebook, and obtains a residue by predicting a speech signal. The sound source quantization section quantizes a sound source signal using the spectrum parameter. The discrimination section discriminates the mode. The sound source quantization section has a codebook for representing a sound source signal by a combination of non-zero pulses and collectively quantizing amplitudes or polarities of the pulses in a predetermined mode, and searches combinations of code vectors and shift amounts used to shift the positions of the pulses to output a combination of a code vector and shift amount which minimizes distortion relative to input speech. The multiplexer section outputs a combination of outputs from the spectrum parameter calculation section, the adaptive codebook section, and the sound source quantization section.

2 Claims, 5 Drawing Sheets

OTHER PUBLICATIONS

Ozawa, K., Nomura, T. and Serizawa, M., "MP-CELP Speech Coding Based on Multipulse Vector Quantization and Fast Search," *Electronics and Communications in Japan*, part 3, vol. 80, No. 11, pp. 55-63, 1997.

Nakizmo, "Signal Analysis and System Identification", Corona, 1988, pp. 82-87.

M. Schroeder et al., "Code-Excited Linear Prediction (CELP): High-Quality Speech at Very Low Bit Rates", AT&T Bell Laboratories, Murray Hill, New Jersey 07974, pp. 937-940.

W. Kleijn et al., "Improved Speech Quality and Efficient Vector Quantization in SELP", International Conference on Acoustics, Speech, and Signal Processing, *Speech Processing*, vol. 1, pp. 155-158, 1988.

C. Laflamme et al., "16 KBPS Wideband Spech Coding Technique Based on Algebraic CELP" International Conference on Acoustics, Speech, and Signal Processing, *Speech Processing*, vol. 1, pp. 13-16, 1988.

N. Sugamura et al., "Speech Data Compression by LSP Speech Analysis-Synthesis Technique", UDC 534.782, pp. 599-605.

T. Nomura et al., "LSP Coding Using VQ-SVQ With Interpolation in 4.075 KBPS M-LCELP Speech Coder", First International Workshop on Mobile Multimedia Communications, SessionB2, Speech ans Coding, pp. b.2.5-1-4, Dec. 7-10, 1993.

P. Kroon et al., "Pitch Predictors With High Temporal Resolution", International Conference on Acoustics, Speech, and Signal Processing, *Speech Processing*, vol. 2, pp. 661-664, 1990.

Y. Linde et al., "An Algorithm for Vector Quantizer Design", IEEE Transactions on Communications, vol. Com-28, No. 1, Jan. 1980.

* cited by examiner

SPEECH CODING APPARATUS AND SPEECH DECODING APPARATUS

BACKGROUND OF THE INVENTION

1. Field of the Invention

The present invention relates to a speech coding apparatus and speech decoding apparatus and, more particularly, to a speech coding apparatus for coding a speech signal at a low bit rate with high quality.

2. Description of the Prior Art

As a conventional method of coding a speech signal with high efficiency, CELP (Code Excited Linear Predictive Coding) is known, which is disclosed, for example, in M. Schroeder and B. Atal, "Code-excited linear prediction: High quality speech at low bit rates", Proc. ICASSP, 1985, pp. 937–940 (reference 1) and Kleijn et al., "Improved speech quality and efficient vector quantization in SELP", Proc. ICASSP, 1988, pp. 155–158 (reference 2).

In this CELP coding scheme, on the transmission side, spectrum parameters representing a spectrum characteristic of a speech signal are extracted from the speech signal for each frame (for example, 20 ms) using linear predictive coding (LPC) analysis. Each frame is divided into subframes (for example, of 5 ms), and for each subframe, parameters for an adaptive codebook (a delay parameter and a gain parameter corresponding to the pitch period) are extracted based on the sound source signal in the past and then the speech signal of the subframe is pitch predicted using the adaptive codebook.

With respect to the sound source signal obtained by the pitch prediction, an optimum sound source code vector is selected from a sound source codebook (vector quantization codebook) consisting of predetermined types of noise signals, and an optimum gain is calculated to quantize the sound source signal.

The selection of a sound source code vector is performed so as to minimize the error power between a signal synthesized based on the selected noise signal and the residue signal. Then, an index and a gain representing the kind of the selected code vector as well as the spectrum parameter and the parameters of the adaptive codebook are combined and transmitted by a multiplexer section. A description of the operation of the reception side will be omitted.

The conventional coding scheme described above is disadvantageous in that a large calculation amount is required to select an optimum sound source code vector from a sound source codebook.

This arises from the fact that, in the methods in references 1 and 2, in order to select a sound source code vector, filtering or convolution calculation is performed once for each code vector, and such calculation is repeated by a number of times equal to the number of code vectors stored in the codebook.

Assume that the number of bits of the codebook is B and the order is N. In this case, if the filter or impulse response length in filtering or convolution calculation is K, the calculation amount required is $N \times K \times 2B \times 8000$ per second. As an example, if B=10, N=40 and k=10, 81,920,000 calculations are required per second. In this manner, the conventional coding scheme is disadvantageous in that it requires a very large calculation size.

Various methods which reduce the calculation amount required to search a sound source codebook have been proposed. One of the methods is an ACELP (Algebraic Code Excited Linear Prediction) method, which is disclosed, for example, in C. Laflamme et al., "16 kbps wideband speech coding technique based on algebraic CELP", Proc. ICASSP, 1991, pp. 13–16 (reference 3).

According to the method disclosed in reference 3, a sound source signal is represented by a plurality of pulses and transmitted while the positions of the respective pulses are represented by predetermined numbers of bits. In this case, since the amplitude of each pulse is limited to +1.0 or −1.0, the calculation amount required to search pulses can be greatly reduced.

As described above, according to the method disclosed in reference 3, a great reduction in calculation amount can be attained.

Another problem is that at a bit rate less than 8 kb/s, especially when background noise is superimposed on speech, the background noise portion of the coded speech greatly deteriorates in sound quality, although the sound quality is good at 8 kb/s or higher.

Such a problem arises for the following reason. Since a sound source is represented by a combination of a plurality of pulses, pulses concentrate near a pitch pulse as the start point of a pitch in a vowel interval of speech. This signal can therefore be efficiently expressed by a small number of pulses. For a random signal like background noise, however, pulses must be randomly generated, and hence the background noise cannot be properly expressed by a small number of pulses. As a consequence, if the bit rate decreases, and the number of pulses decreases, the sound quality of background noise abruptly deteriorates.

SUMMARY OF THE INVENTION

The present invention has been made in consideration of the above situation in the prior art, and has as its object to provide a speech coding system which can solve the above problems and suppress a deterioration in sound quality in terms of background noise, in particular, with a relatively small calculation amount.

In order to achieve the above object, a speech coding apparatus according to the first aspect of the present invention including a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, and a sound source quantization section for quantizing a sound source signal of the speech signal by using the spectrum parameter and outputting the sound source signal is characterized by comprising a discrimination section for discriminating a mode on the basis of a past quantized gain of an adaptive codebook, a sound source quantization section which has a codebook for representing a sound source signal by a combination of a plurality of non-zero pulses and collectively quantizing amplitudes or polarities of the pulses when an output from the discrimination section indicates a predetermined mode, and searches combinations of code vectors stored in the codebook and a plurality of shift amounts used to shift positions of the pulses so as to output a combination of a code vector and shift amount which minimizes distortion relative to input speech, and a multiplexer section for outputting a combination of an output from the spectrum parameter calculation section, an output from the adaptive codebook section, and an output from the sound source quantization section.

A speech coding apparatus according to the second aspect of the present invention including a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, and a sound source quantization section for quantizing a sound source signal of the speech signal by using the spectrum parameter and outputting the sound source signal, is characterized by comprising a discrimination section for discriminating a mode on the basis of a past quantized gain of an adaptive codebook, a sound source quantization section which has a codebook for representing a sound source signal by a combination of a plurality of non-zero pulses and collectively quantizing amplitudes or polarities of the pulses when an output from the discrimination section indicates a predetermined mode, and outputs a code vector that minimizes distortion relative to input speech by generating positions of the pulses according to a predetermined rule, and a multiplexer section for outputting a combination of an output from the spectrum parameter calculation section, an output from the adaptive codebook section, and an output from the sound source quantization section.

A speech coding apparatus according to the third aspect of the present invention including a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, and a sound source quantization section for quantizing a sound source signal of the speech signal by using the spectrum parameter and outputting the sound source signal is characterized by comprising a discrimination section for discriminating a mode on the basis of a past quantized gain of an adaptive codebook, a sound source quantization section which has a codebook for representing a sound source signal by a combination of a plurality of non-zero pulses and collectively quantizing amplitudes or polarities of the pulses when an output from the discrimination section indicates a predetermined mode, and a gain codebook for quantizing gains, and searches combinations of code vectors stored in the codebook, a plurality of shift amounts used to shift positions of the pulses, and gain code vectors stored in the gain codebook so as to output a combination of a code vector, shift amount, and gain code vector which minimizes distortion relative to input speech, and a multiplexer section for outputting a combination of an output from the spectrum parameter calculation section, an output from the adaptive codebook section, and an output from the sound source quantization section.

A speech coding apparatus according to the fourth aspect of the present invention including a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, and a sound source quantization section for quantizing a sound source signal of the speech signal by using the spectrum parameter and outputting the sound source signal is characterized by comprising a discrimination section for discriminating a mode on the basis of a past quantized gain of an adaptive codebook, a sound source quantization section which has a codebook for representing a sound source signal by a combination of a plurality of non-zero pulses and collectively quantizing amplitudes or polarities of the pulses when an output from the discrimination section indicates a predetermined mode, and a gain codebook for quantizing gains, and outputs a combination of a code vector and gain code vector which minimizes distortion relative to input speech by generating positions of the pulses according to a predetermined rule, and a multiplexer section for outputting a combination of an output from the spectrum parameter calculation section, an output from the adaptive codebook section, and an output from the sound source quantization section.

A speech decoding apparatus according to the fifth aspect of the present invention is characterized by comprising a demultiplexer section for receiving and demultiplexing a spectrum parameter, a delay of an adaptive codebook, a quantized gain, and quantized sound source information, a mode discrimination section for discriminating a mode by using a past quantized gain in the adaptive codebook, and a sound source signal reconstructing section for reconstructing a sound source signal by generating non-zero pulses from the quantized sound source information when an output from the discrimination section indicates a predetermined mode, wherein a speech signal is reproduced by passing the sound source signal through a synthesis filter section constituted by spectrum parameters.

As is obvious from the above aspects, according to the present invention, the mode is discriminated on the basis of the past quantized gain of the adaptive codebook. If a predetermined mode is discriminated, combinations of code vectors stored in the codebook, which are used to collectively quantize the amplitude or polarities of a plurality of pulses, and a plurality of shift amounts used to temporally shift predetermined pulse positions are searched to select a combination of a code vector and shift amount which minimizes distortion relative to input speech. With this arrangement, even if the bit rate is low, a background noise portion can be properly coded with a relatively small calculation amount.

In addition, according to the present invention, a combination of a code vector, shift amount, and gain code vector which minimizes distortion relative to input speech is selected by searching combinations of code vectors, a plurality of shift amounts, and gain code vectors stored in the gain codebook for quantizing gains. With this operation, even if speech on which background noise is superimposed is coded at a low bit rate, a background noise portion can be properly coded.

The above and many other objects, features and advantages of the present invention will become manifest to those skilled in the art upon making reference to the following detailed description and accompanying drawings in which preferred embodiments incorporating the principles of the present invention are shown by way of illustrative examples.

DETAILED DESCRIPTION OF PREFERRED EMBODIMENTS

Figure 1:
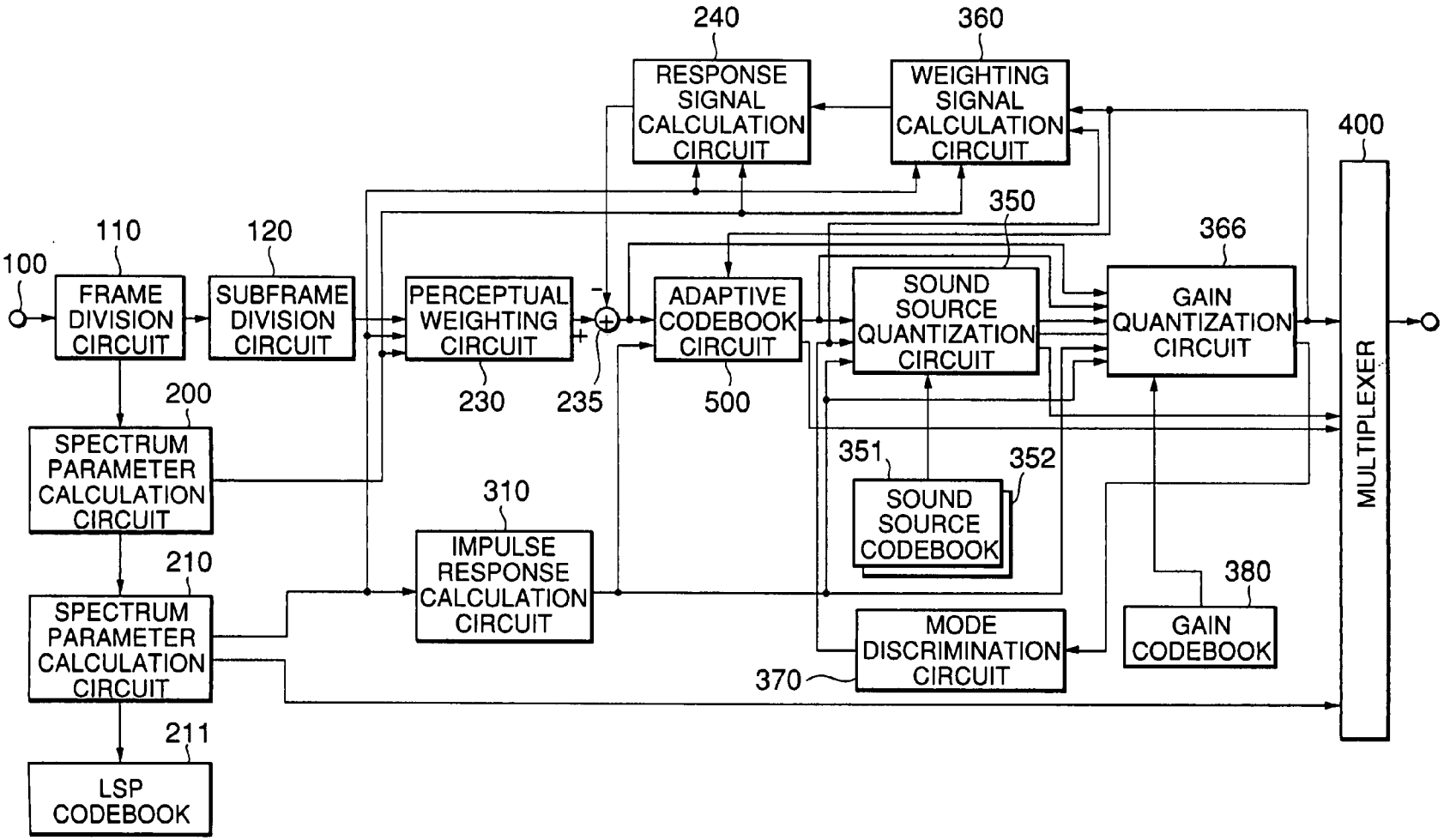
FIG. 1 is a block diagram showing the schematic arrangement of the first embodiment of the present invention.

Several embodiments of the present invention will be described below with reference to the accompanying drawings. In a speech coding apparatus according to an embodiment of the present invention, a mode discrimination circuit (370 in FIG. 1) discriminates the mode on the basis of the past quantized gain of an adaptive codebook. When a predetermined mode is discriminated, a sound source quantization circuit (350 in FIG. 1) searches combinations of code vectors stored in a codebook (351 or 352 in FIG. 1), which is used to collectively quantize the amplitudes or polarities of a plurality of pulses, and a plurality of shift amounts used to temporally shift predetermined pulse positions, to select a combination of a code vector and shift amount which minimizes distortion relative to input speech. A gain quantization circuit (366 in FIG. 1) quantizes gains by using a gain codebook (380 in FIG. 1).

According to a preferred embodiment of the present invention, a speech decoding apparatus includes a demultiplexer section (510 in FIG. 5) for receiving and demultiplexing a spectrum parameter, a delay of an adaptive codebook, a quantized gain, and quantized sound source information, a mode discrimination section (530 in FIG. 5) for discriminating the mode on the basis of the past quantized gain of the adaptive codebook, and a sound source decoding section (540 in FIG. 5) for reconstructing a sound source signal by generating non-zero pulses from the quantized sound source information. A speech signal is reproduced or resynthesized by passing the sound source signal through a synthesis filter (560 in FIG. 5) defined by spectrum parameters.

According to a preferred embodiment of the present invention, a speech coding apparatus according to the first aspect of the present invention includes a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, and a sound source quantization section for quantizing a sound source signal of the speech signal by using the spectrum parameter and outputting the sound source signal is characterized by comprising a discrimination section or discriminating a mode on the basis of a past quantized gain of an adaptive codebook, a sound source quantization section which has a codebook for representing a sound source signal by a combination of a plurality of non-zero pulses and collectively quantizing amplitudes or polarities of the pulses when an output from the discrimination section indicates a predetermined mode, and searches combinations of code vectors stored in the codebook and a plurality of shift amounts used to shift positions of the pulses so as to output a combination of a code vector and shift amount which minimizes distortion relative to input speech, and a multiplexer section for outputting a combination of an output from the spectrum parameter calculation section, an output from the adaptive codebook section, an output from the sound source quantization section, a demultiplexer section for receiving and demultiplexing a spectrum parameter, a delay of an adaptive codebook, a quantized gain, and quantized sound source information, a mode discrimination section for discriminating a mode by using a past quantized gain in the adaptive codebook, and a sound source signal reconstructing section for reconstructing a sound source signal by generating non-zero pulses from the quantized sound source information when an output from the discrimination section indicates a predetermined mode. A speech signal is reproduced by passing the sound source signal through a synthesis filter section constituted by spectrum parameters.

A speech coding apparatus according to the present invention includes a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, and a sound source quantization section for quantizing a sound source signal of the speech signal by using the spectrum parameter and outputting the sound source signal, is characterized by comprising a discrimination section for discriminating a mode on the basis of a past quantized gain of an adaptive codebook, a sound source quantization section which has a codebook for representing a sound source signal by a combination of a plurality of non-zero pulses and collectively quantizing amplitudes or polarities of the pulses when an output from the discrimination section indicates a predetermined mode, and outputs a code vector that minimizes distortion relative to input speech by generating positions of the pulses according to a predetermined rule, and a multiplexer section for outputting a combination of an output from the spectrum parameter calculation section, an output from the adaptive codebook section, an output from the sound source quantization section, a demultiplexer section for receiving and demultiplexing a spectrum parameter, a delay of an adaptive codebook, a quantized gain, and quantized sound source information, a mode discrimination section for discriminating a mode by using a past quantized gain in the adaptive codebook, and a sound source signal reconstructing section for reconstructing a sound source signal by generating pulse positions according to a predetermined rule and generating amplitudes or polarities for the pulses from a code vector to generate a sound source signal when the output from the discrimination section indicates a predetermined mode. A speech signal is reproduced by passing the sound source signal through a synthesis filter section constituted by spectrum parameters.

First Embodiment:

FIG. 1 is a block diagram showing the arrangement of a speech coding apparatus according to an embodiment of the present invention.

Referring to FIG. 1, when a speech signal is input through an input terminal 100, a frame division circuit 110 divides the speech signal into frames (for example, of 20 ms). A subframe division circuit 120 divides the speech signal of each frame into subframes (for example, of 5 ms) shorter than the frames.

A spectrum parameter calculation circuit 200 extracts speech from the speech signal of at least one subframe using a window (for example, of 24 ms) longer than the subframe length and calculates spectrum parameters by computations of a predetermined order (for example, P= 10). In this case, for the calculation of spectrum parameters, an LPC analysis, a Burg analysis, and the like which are well known in the art can be used. In this case, the Burg analysis is used. Since the Burg analysis is disclosed in detail in Nakamizo, "Signal Analysis and System Identification", Corona, 1988, pp. 82–87 (reference 4), a description thereof will be omitted.

In addition, a spectrum parameter calculation circuit 210 transforms linear predictive coefficients α il (i=1, . . . , 10) calculated using the Burg method into LSP parameters suitable for quantization and interpolation. Such transformation from linear predictive coefficients into LSP parameters is disclosed in Sugamura et al., "Speech Data Compression by LSP Speech Analysis-Synthesis Technique", Journal of the Electronic Communications Society of Japan, J64-A, 1981, pp. 599–606 (reference 5).

For example, linear predictive coefficients calculated for the second and fourth subframes based on the Burg method are transformed into LSP paramete3rs whereas LSP parameters for the first and third subframes are determined by linear interpolation, and the LSP parameters of the first and third subframes are inversely transformed into linear predictive coefficients. Then, the linear predictive coefficients α il (i=1, . . . , 10, l=1, . . . ,5) of the first to fourth subframes are output to a perceptual weighting circuit 230. The LSP parameters of the fourth subframe are output to the spectrum parameter quantization circuit 210.

The spectrum parameter quantization circuit 210 efficiently quantizes the LSP parameters of a predetermined subframe from the spectrum parameters and outputs a quantization value which minimizes the distortion given by:

$$D_j = \sum_{i=1}^{p} W(i)[LSP(i) - QLSP(i)_j]^2 \tag{1}$$

where LSP(i), $QLSP(i)_j$, and W(i) are the LSP parameters of the ith-order before quantization, the jth result after the quantization, and the weighting coefficient, respectively.

In the following description, it is assumed that vector quantization is used as a quantization method, and LSP parameters of the fourth subframe are quantized. Any known technique can be employed as the technique for vector quantization of LSP parameters. More specifically, a technique disclosed in, for example, Japanese Unexamined Patent Publication No. 4-171500 (Japanese Patent Application No. 2-297600) (reference 6), Japanese Unexamined Patent Publication No. 4-363000 (Japanese Patent Application No. 3-261925) (reference 7), Japanese Unexamined Patent Publication No. 5-6199 (Japanese Patent Application No. 3-155049) (reference 8), T. Nomura et al., "LSP Coding VQ-SVQ with Interpolation in 4.075 kbps M-LCELP Speech Coder", Proc. Mobile Multimedia Communications, 1993, pp. B.2.5 (reference 9) or the like can be used. Accordingly, a description of details of the technique is omitted herein.

The spectrum parameter quantization circuit 210 reconstructs the LSP parameters of the first to fourth subframes based on the LSP parameters quantized with the fourth subframe. Here, linear interpolation of the quantization LSP parameters of the fourth subframe of the current frame and the quantization LSP parameters of the fourth subframe of the immediately preceding frame is performed to reconstruct LSP parameters of the first to third subframes.

In this case, after a code vector which minimizes the error power between the LSP parameters before quantization and the LSP parameters after quantization is selected, the LSP parameters of the first to fourth subframes are reconstructed by linear interpolation. In order to further improve the performance, after a plurality of candidates are first selected as a code vector which minimizes the error power, the accumulated distortion may be evaluated with regard to each of the candidates to select a set of a candidate and an interpolation LSP parameter which exhibit a minimum accumulated distortion. The details of this technique are disclosed, for example, in Japanese Patent Application No. 5-8737 (reference 10).

The LSP parameters of the first to third subframes reconstructed in such a manner as described above and the quantization LSP parameters of the fourth subframe are transformed into linear predictive coefficients α ii (i=1, . . . , 10, l=1, . . . , 5) for each subframe, and the linear predictive coefficients are output to the impulse response calculation circuit 310. Furthermore, an index representing the code vector of the quantization LSP parameters of the fourth subframe is output to a multiplexer 400.

The perceptual weighting circuit 230 receives the linear predictive coefficients α il (i=1, . . . , 10, l=1, . . . , 5) before quantization for each subframe from the spectrum parameter calculation circuit 200, performs perceptual weighting for the speech signal of the subframe on the basis of the method described in reference 1 and outputs a resultant preceptual weighting signal.

A response signal calculation circuit 240 receives the linear predictive coefficients α il for each subframe from the spectrum parameter calculation circuit 200, receives the linear predictive coefficients α ii reconstructed by quantization and interpolation for each subframe from the spectrum parameter quantization circuit 210, calculates, for one subframe, a response signal with which the input signal is reduced to zero d(n)=0 using a value stored in an interval filter memory, and outputs the response signal to a subtracter 235. In this case, the response signal $x_2(n)$ is represented by:

$$x_2(n) = d(n) - \sum_{i=1}^{10} \alpha_i d(n-i) \sum_{i=1}^{10} \alpha_i \gamma^i y(n-i) + \sum_{i=1}^{10} \alpha'_i \gamma^i x_x(n-i) \tag{2}$$

If n−i<0, then $$y(n-i)-p(N+(n-i)) \tag{3}$$

$$x_2(n-i)=s_w(N+(n-i)) \tag{4}$$

where N is the subframe length, γ is the weighting coefficient for controlling the perceptual weighting amount and has a value equal to the value of equation (7) given below, and $s_w(n)$ and p(n) are an output signal of a weighting signal calculation circuit 360 and an output signal of the term of the denominator of a filter described by the first term of the right side of equation (7), respectively.

The subtracter 235 subtracts response signals x2(n) corresponding to one subframe from the perceptual weighting signal $x_w(n)$ by:

$$x'_w(n)=x_w(n)-x'_w(n) \tag{5}$$

and outputs a signal $x'_w(n)$ to an adaptive codebook circuit 500.

The impulse response calculation circuit 310 calculates only a predetermined number L of impulse responses $h_w(n)$ of a perceptual weighting filter H(z) whose z-transform (transfer function) is represented by:

$$H_w(Z) = \frac{1 - \sum_{i=1}^{10} \alpha_i Z^{-i}\ 1}{1 - \sum_{i=1}^{10} \alpha_i \gamma^i Z^{-i} 1 - \sum_{i=1}^{10} \alpha_i' \gamma^i Z^{-i}} \tag{6}$$

and outputs them to the adaptive codebook circuit 500 and a sound source quantization circuit 350.

The adaptive codebook circuit 500 receives a sound source signal v(n) in the past from a gain quantization circuit 366, receives the output signal $x'_{(n)}$ from the subtractor 235 and the impulse responses $h_w(n)$ from the impulse response calculation circuit 310. Then, the adaptive codebook circuit 500 calculates a delay $D_T$ corresponding to pitch, which minimizes the distortion given by:

$$D_T = \sum_{n=0}^{N-1} x_w'^2(n) - \frac{\left[\sum_{n=0}^{N-1} x_w'(n) y_w(n-T)\right]^2}{\left[\sum_{n-0}^{N-1} y_w^2(n-T)\right]} \tag{7}$$

$$\text{for } y_w(n-T) = v(n-T) * h_w(n) \tag{8}$$

and outputs an index representing the delay to the multiplexer 400, where the symbol * signifies a convolution calculation.

$$\beta = \sum_{n=0}^{N-1} x_w'(n) y_w(n-T) \Big/ \sum_{n=0}^{N-1} y_w^2(n-T) \tag{9}$$

In this case, in order to improve the extraction accuracy of a delay for the voice of a woman or a child, the delay may be calculated not as an integer sample value but a decimal fraction sample value. A detailed method is disclosed, for example, in P. Kroon et. al., "Pitch predictors with high terminal resolution", Proc. ICASSP, 1990, pp. 661–664 (reference 11).

In addition, the adaptive codebook circuit 500 performs pitch prediction:

$$e_w(n) = x'_w(n) - \beta v(n-T) * h_w(n) \tag{10}$$

and outputs a resultant predictive residue signal $e_w(n)$ to the sound source quantization circuit 350.

A mode discrimination circuit 370 receives the adaptive codebook gain β quantized by the gain quantization circuit 366 one subframe ahead of the current subframe, and compares it with a predetermined threshold Th to perform voiced/unvoiced determination. More specifically, if β is larger than the threshold Th, a voiced sound is determined. If β is smaller than the threshold Th, an unvoiced sound is determined. The mode discrimination circuit 370 then outputs a voiced/unvoiced discrimination information to the sound source quantization circuit 350, the gain quantization circuit 366, and the weighting signal calculation circuit 360.

The sound source quantization circuit 350 receives the voiced/unvoiced discrimination information and switches pulses depending on whether a voiced or an unvoiced sound is determined.

Assume that M pulses are generated for a voiced sound.

For a voiced sound, a B-bit amplitude codebook or polarity codebook is used to collectively quantize the amplitudes of pules in units of M pulses. A case wherein the polarity codebook is used will be described below. This polarity codebook is stored in a codebook 351 for a voiced sound, and is stored in a codebook 352 for an unvoiced sound.

For a voiced sound, the sound source quantization circuit 350 reads out polarity code vectors from the codebook 351, assigns positions to the respective code vectors, and selects a combination of a code vector and a position which minimizes the distortion given by:

$$D_k = \sum_{n=0}^{N-1} \left[ e_w(n) - \sum_{i=1}^{M} g_{ik}' h_w(n - m_i) \right]^2 \tag{11}$$

where $h_w(n)$ is the perceptual weighting impulse response.

Equation (11) can be minimized by obtaining a combination of an amplitude code vector k and a position $m_i$ which maximizes $D_{(k,i)}$ given by:

$$D_{(k,j)} = \frac{\left[\sum_{n=0}^{N-1} e_w(n) s_{wk}(m_i)\right]^2}{\sum_{n=0}^{N-1} s_{wk}^2(m_i)} \tag{12}$$

where $s_{wk}(m_i)$ is calculated according to equation (5) above.

$$D_{(k,j)} = \left[\sum_{n=0}^{N-1} \phi(n) v_k(n)\right]^2 \Big/ \sum_{n=0}^{N-1} s_{wk}^2(m_i) \tag{13}$$

$$\text{for } \phi(n) = \sum_{i=n}^{N-1} e_w(i) h_w(i-n),\ n = 0, \ldots, N-1 \tag{14}$$

In this case, to reduce the calculation amount, the positions that the respective pulses can assume for a voiced sound can be limited as in reference 3. If, for example, N=40 and M=5, the possible positions of the respective pulses are given by Table 1.

TABLE 1

| |
|---|
| 0, 5, 10, 15, 20, 25, 30, 35 |
| 1, 6, 11, 16, 21, 26, 31, 36 |
| 2, 6, 12, 17, 22, 27, 32, 37 |
| 3, 8, 13, 18, 23, 28, 33, 38 |
| 4, 9, 14, 19, 24, 29, 34, 39 |

An index representing a code vector is then output to the multiplexer 400.

Furthermore, a pulse position is quantized with a predetermined number of bits, and an index representing the position is output to the multiplexer 400.

For unvoiced periods, as indicated by Table 2, pulse positions are set at predetermined intervals, and shift amounts for shifting the positions of all pulses are determined in advance. In the following case, the pulse positions are shifted in units of samples, and fourth types of shift amounts (shift 0, shift 1, shift 2, and shift 3) can be used. In this case, the shift amounts are quantized with two bits and transmitted.

TABLE 2

| Pulse Position |
|---|
| 0, 4, 8, 12, 16, 20, 24, 28, . . . |

The sound source quantization circuit 350 further receives polarity code vectors from the polarity codebook (sound source codebook) 352, and searches combinations of all shift amounts and all code vectors to select a combination of a shift amount δ (j) and a code vector gk which minimizes the distortion given by:

$$D_{kj} = \sum_{n=0}^{N-1}\left[e_w(n) - \sum_{i=1}^{M} g'_{ik} h_w(n - m_i - \delta(j))\right]^2 \tag{15}$$

An index representing the selected code vector and a code representing the selected shift amount are sent to the multiplexer 400.

Note that a codebook for quantizing the amplitudes of a plurality of pulses can be learnt in advance by using speech signals and stored. A learning method for the codebook is disclosed, for example, in "An algorithm for vector quantization design", IEEE Trans. Commun., January 1980, pp. 84–95) (reference 12).

The information of amplitudes and positions of voiced and unvoiced periods are output to the gain quantization circuit 366.

The gain quantization circuit 366 receives the amplitude and position information from the sound source quantization circuit 350, and receives the voiced/unvoiced discrimination information from the mode discrimination circuit 370.

The gain quantization circuit 366 reads out gain code vectors from a gain codebook 380 and selects one gain code vector that minimizes equation (16) below for the selected amplitude code vector or polarity code vector and the position. Assume that both the gain of the adaptive codebook and the sound source gain represented by a pulse are vector quantized simultaneously.

When the discrimination information indicates a voiced sound, a gain code vector is obtained to minimize $D_k$ given by:

$$D_k = \sum_{n=0}^{N-1}\left[x_w(n) - \beta'_i v(n-T) * h_w(n) - G'_i \sum_{i=1}^{M} g'_{ik} h_w(n - m_i)\right]^2 \tag{16}$$

where $\beta_k$ and Gk are kth code vectors in a two-dimensional gain codebook stored in the gain codebook 380. An index representing the selected gain code vector is output to the multiplexer 400.

If the discrimination information indicates an unvoiced sound, a gain code vector is searched out which minimizes $D_k$ given by:

$$D_k = \sum_{n=0}^{N-1}\left[x_w(n) - \beta'_i v(n-T) * h_w(n) - G'_i \sum_{i=1}^{M} g'_{ik} h_w(n - m_i - \delta(j))\right]^2 \tag{17}$$

An index representing the selected gain code vector is output to the multiplexer 400.

The weighting signal calculation circuit 360 receives the voiced/unvoiced discrimination information and the respective indices and reads out the corresponding code vectors according to the indices. For a voiced sound, the driving sound source signal v(n) is calculated by:

$$v(n) = \beta'_i v(n-T) + G'_i \sum_{i=1}^{M} g'_{ik}\delta(n - m_i) \tag{18}$$

This driving sound source signal v(n) is output to the adaptive codebook circuit 500.

For an unvoiced sound, the driving sound source signal v(n) is calculated by:

$$v(n) = \beta'_i v(n-T) + G'_i \sum_{i=1}^{M} g'_{ik}\delta(n - m_i - \delta(i)) \tag{19}$$

This driving sound source signal v(n) is output to the adaptive codebook circuit 500.

Subsequently, the response signals $s_w(n)$ are calculated in units of subframes by using the output parameters from the spectrum parameter calculation circuit 200 and spectrum parameter calculation circuit 210 using $$s_w(n) = v(n) - \sum_{i=1}^{10} a_i v(n-i) + \sum_{i=1}^{10} a_i \gamma^i p(n-i) + \sum_{i=1}^{10} a'_i \gamma^i s_w(n-i) \tag{20}$$

and are output to the response signal calculation circuit 240.

Second Embodiment

Figure 2:
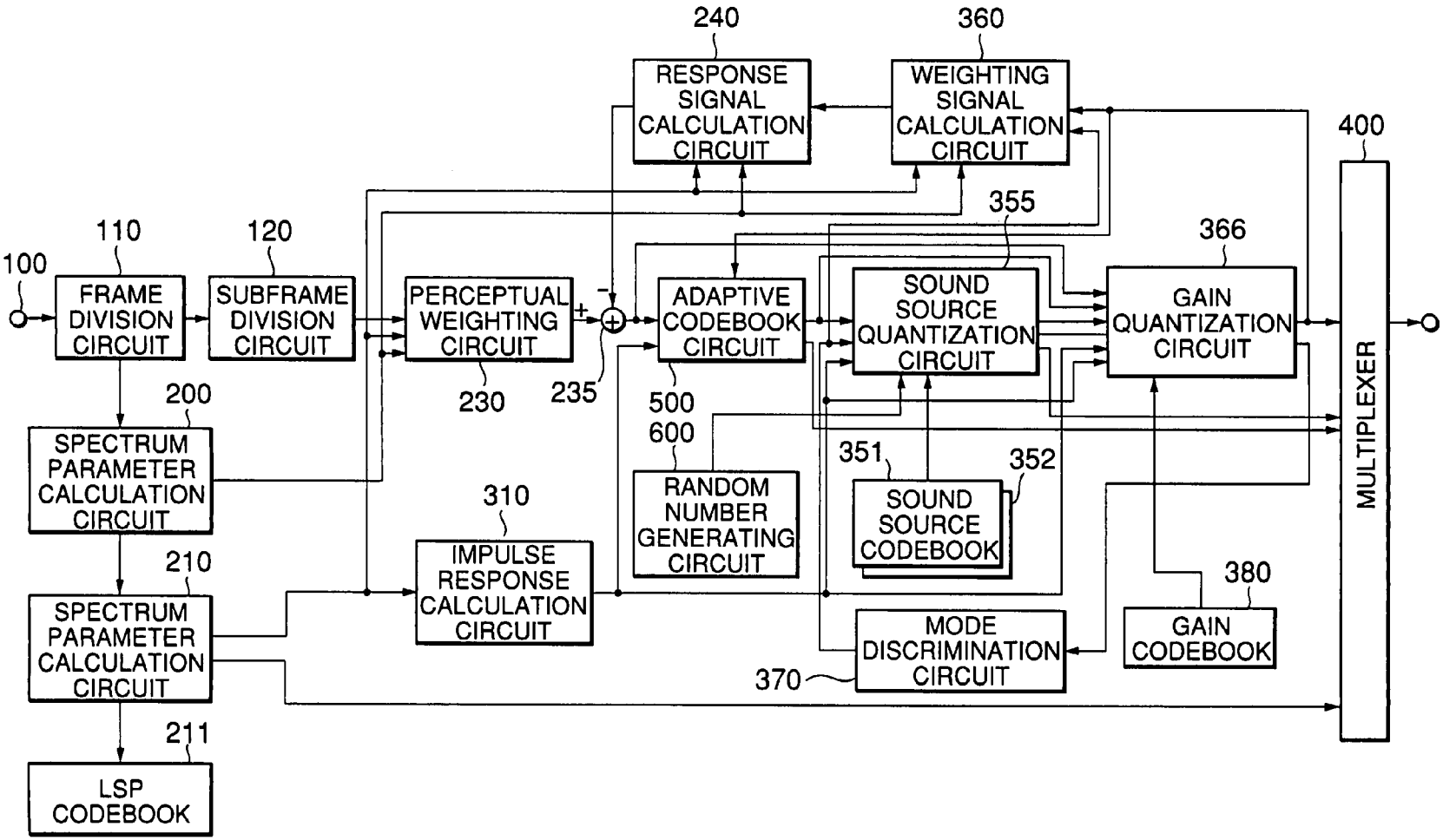
FIG. 2 is a block diagram showing the schematic arrangement of the second embodiment of the present invention.

FIG. 2 is a block diagram showing the schematic arrangement of the second embodiment of the present invention.

Referring to FIG. 2, the second embodiment of the present invention differs from the above embodiment in the operation of a sound source quantization circuit 355. More specifically, when voiced/unvoiced discrimination information indicates an unvoiced sound, the positions that are generated in advance in accordance with a predetermined rule are used as pulse positions.

For example, a random number generating circuit 600 is used to generate a predetermined number of (e.g., M1) pulse positions. That is, the M1 values generated by the random number generating circuit 600 are used as pulse positions. The M1 positions generated in this manner are output to the sound source quantization circuit 355.

If the discrimination information indicates a voiced sound, the sound source quantization circuit 355 operates in the same manner as the sound source quantization circuit 350 in FIG. 1. If the information indicates an unvoiced sound, the amplitudes or polarities of pulses are collectively quantized by using a sound source codebook 352 in correspondence with the positions output from the random number generating circuit 600.

Third Embodiment

Figure 3:
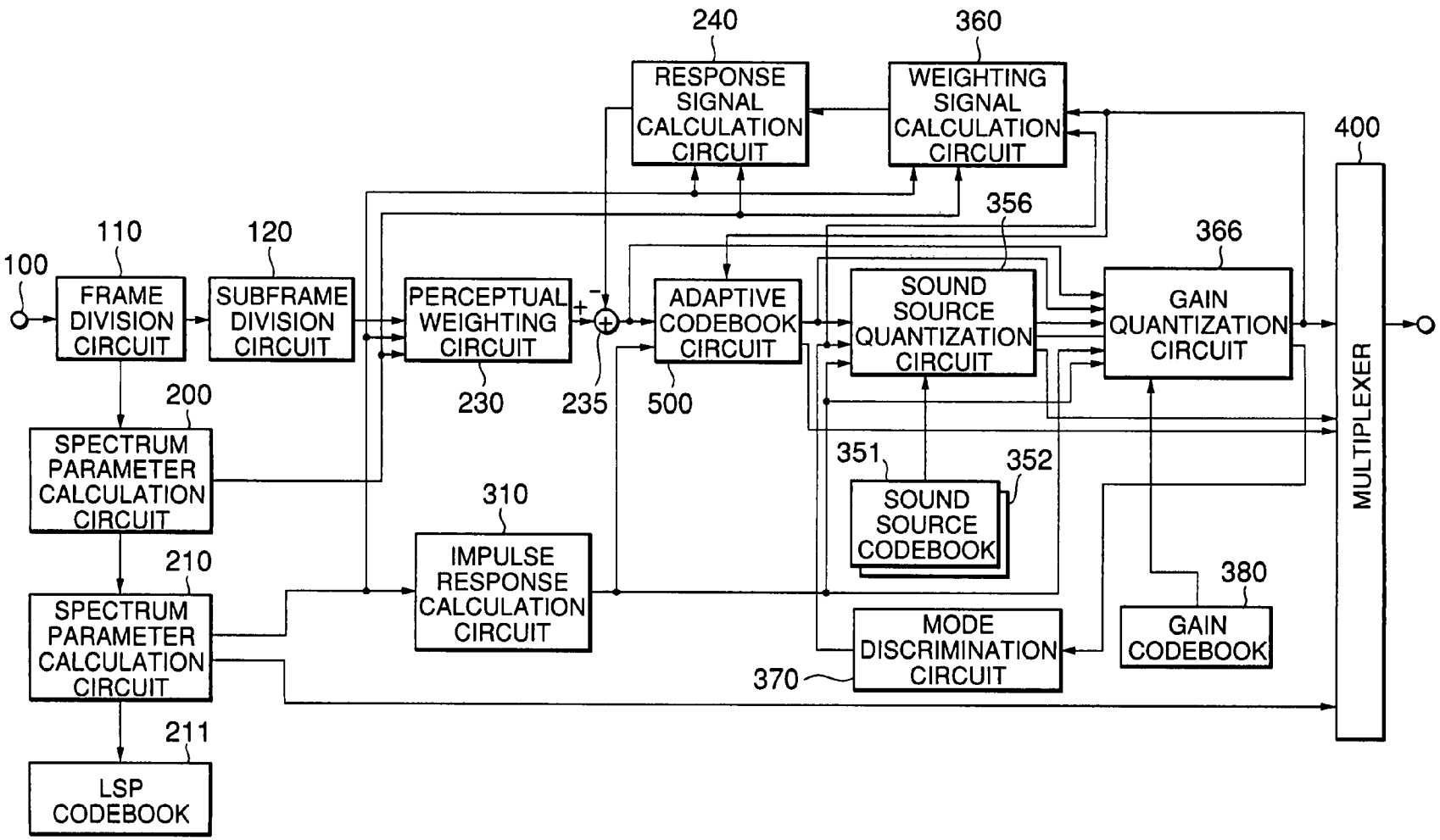
FIG. 3 is a block diagram showing the schematic arrangement of the third embodiment of the present invention.

FIG. 3 is a block diagram showing the arrangement of the third embodiment of the present invention.

Referring to FIG. 3, in the third embodiment of the present invention, when voiced/unvoiced discrimination information indicates an unvoiced sound, a sound source quantization circuit 356 calculates the distortions given by equations (21) below in correspondence with all the combinations of all the code vectors in a sound source codebook 352 and the shift amounts of pulse positions, selects a plurality of combinations in the order which minimizes the distortions given by:

$$D_{k,j} = \sum_{n=0}^{N-1} \left[ e_w(n) - \sum_{i=1}^{M} g'_{ik} h_w(n - m_i - \delta(j)) \right]^2 \tag{21}$$

and outputs them to a gain quantization circuit 366.

The gain quantization circuit 366 quantizes gains for a plurality of sets of outputs from the sound source quantization circuit 356 by using a gain codebook 380, and selects a combination of a shift amount, sound source code vector, and gain code vector which minimizes distortions given by:

$$D_{k,j} = \sum_{n=0}^{N-1} \left[ x_w(n) - \beta'_i v(n-T) * h_w(n) - G'_i \sum_{i=1}^{M} g'_{ik} h_w(n - m_i - \delta(j)) \right]^2 \tag{22}$$

Fourth Embodiment

Figure 4:
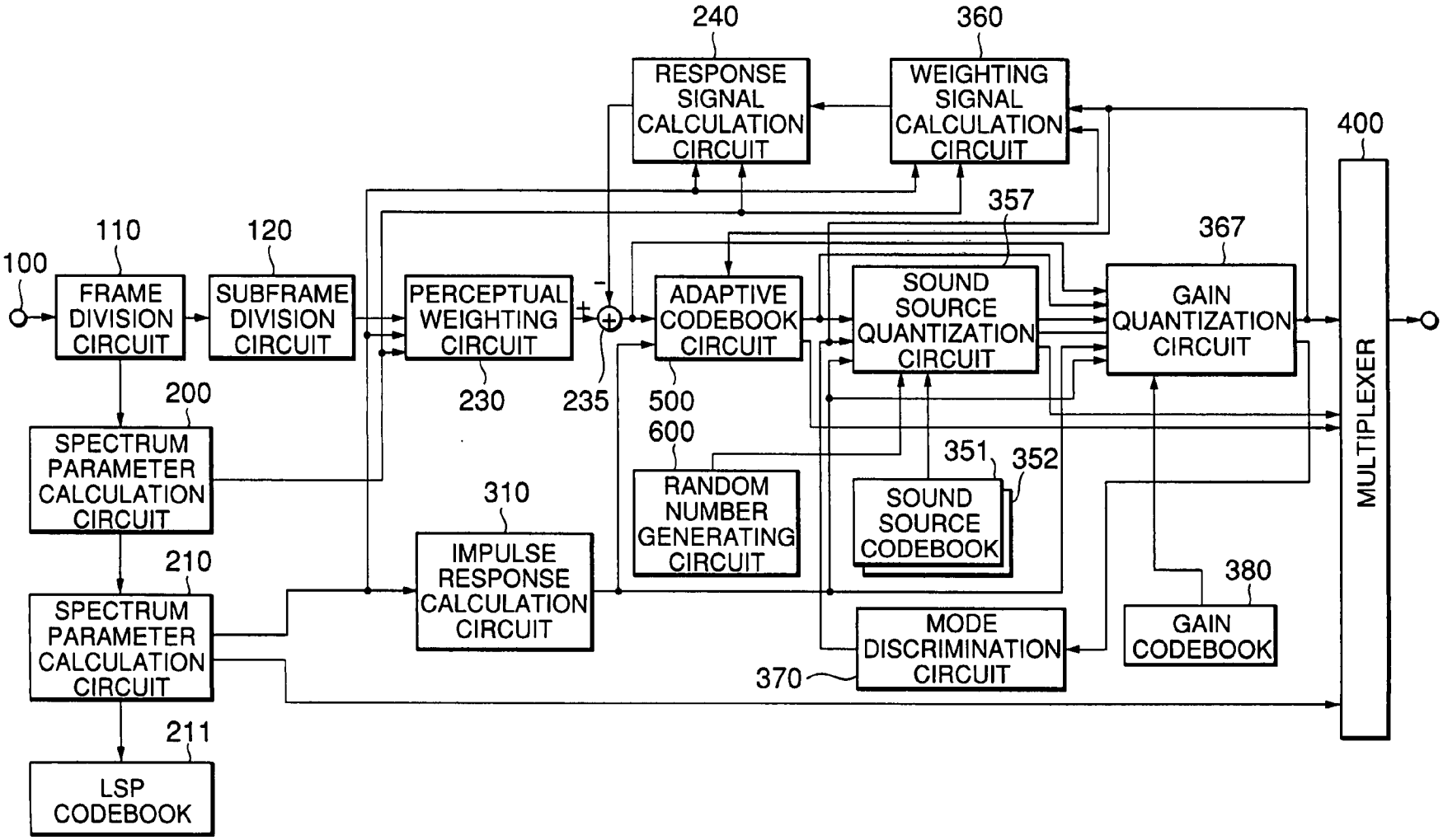
FIG. 4 is a block diagram showing the schematic arrangement of the fourth embodiment of the present invention.

FIG. 4 is a block diagram showing the arrangement of the fourth embodiment of the present invention.

Referring to FIG. 4, in the fourth embodiment of the present invention, when voiced/unvoiced discrimination information indicates an unvoiced sound, a sound source quantization circuit 357 collectively quantizes the amplitudes or polarities of pulses for the pulse positions generated by a random number generating circuit 600 by using a sound source codebook 352, and outputs all the code vectors or a plurality of code vector candidates to a gain quantization circuit 367.

The gain quantization circuit 367 quantizes gains for the respective candidates output from the sound source quantization circuit 357 by using a gain codebook 380, and outputs a combination of a code vector and gain code vector which minimizes distortion.

Fifth Embodiment

Figure 5:
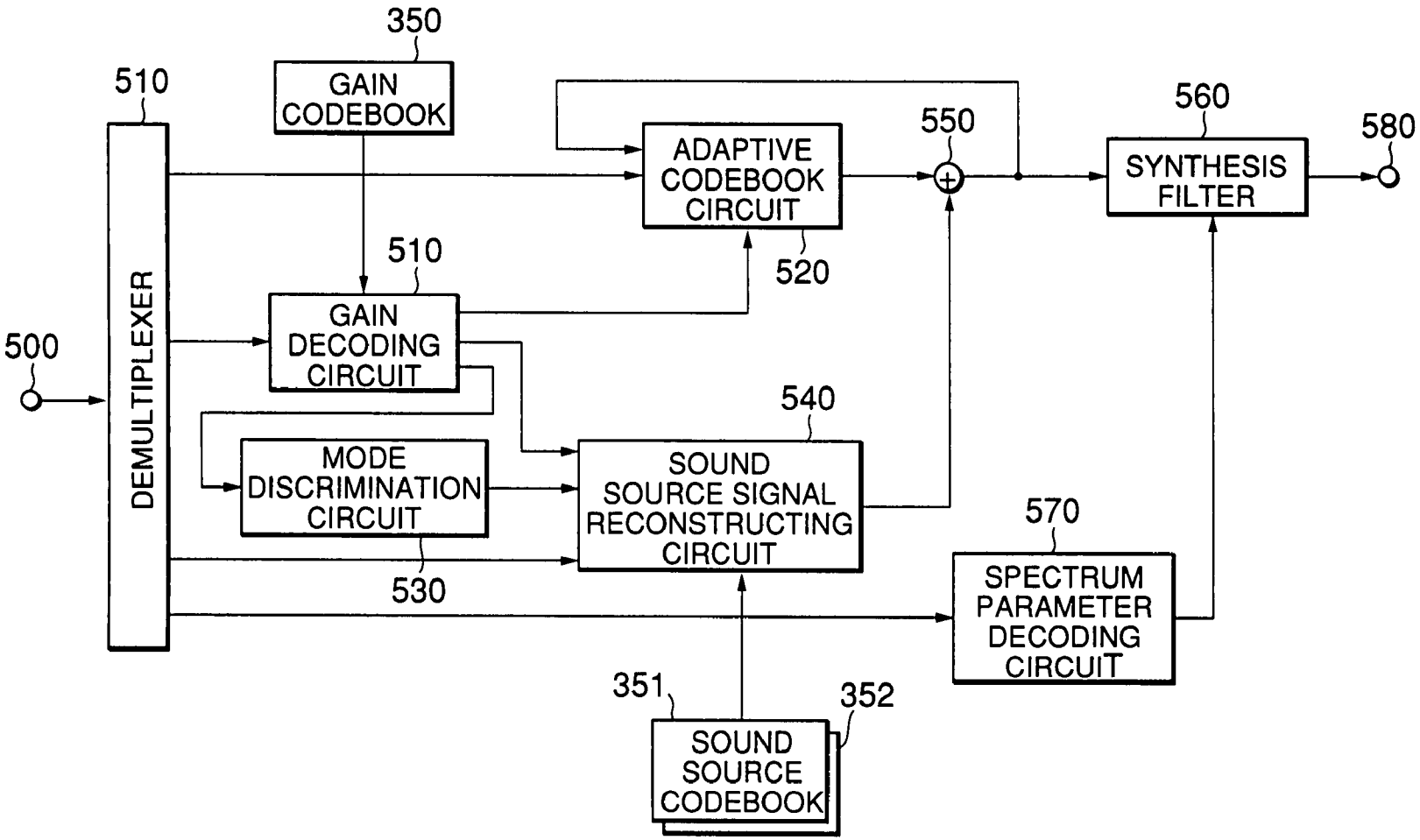
FIG. 5 is a block diagram showing the schematic arrangement of the fifth embodiment of the present invention.

FIG. 5 is a block diagram showing the arrangement of the fifth embodiment of the present invention.

Referring to FIG. 5, in the fifth embodiment of the present invention, a demultiplexer section 510 demultiplexes a code sequence input through an input terminal 500 into a spectrum parameter, an adaptive codebook delay, an adaptive codebook vector, a sound source gain, an amblitude or polarity code vector as sound source information, and a code representing a pulse position, and outputs them.

The demultiplexer section 510 decodes the adaptive codebook and sound source gains by using a gain codebook 380 and outputs them.

An adaptive codebook circuit 520 decodes the delay and adaptive codebook vector gains and generates an adaptive codebook reconstruction signal by using a synthesis filter input signal in a past subframe.

A mode discrimination circuit 530 compares the adaptive codebook gain decoded in the past subframe with a predetermined threshold to discriminate whether the current subframe is voiced or unvoiced, and outputs the voiced/unvoiced discrimination information to a sound source signal reconstructing circuit 540.

The sound source signal reconstructing circuit 540 receives the voiced/unvoiced discrimination information. If the information indicates a voiced sound, the sound source signal reconstructing circuit 540 decodes the pulse positions, and reads out code vectors from a sound source codebook 351. The circuit 540 then assigns amplitudes or polarities to the vectors to generate a predetermined number of pulses per subframe, thereby reclaiming a sound source signal.

When the voiced/unvoiced discrimination information indicates an unvoiced sound, the sound source signal reconstructing circuit 540 reconstructs pulses from predetermined pulse positions, shift amounts, and amplitude or polarity code vectors.

A spectrum parameter decoding circuit 570 decodes a spectrum parameter and outputs the resultant data to a synthesis filter 560.

An adder 550 adds the adaptive codebook output signal and the output signal from the sound source signal reconstructing circuit 540 and outputs the resultant signal to the synthesis filter 560.

The synthesis filter 560 receives the output from the adder 550, reproduces speech, and outputs it from a terminal 580.

What is claimed is:

1. A speech coding/decoding apparatus comprising:

a speech coding apparatus including:

a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, a sound source quantization section for quantizing a sound source signal of the speech signal by using the spectrum parameter and outputting the sound source signal, a discrimination section for discriminating a voice sound mode and an unvoiced sound mode on the basis of a past quantized gain of a adaptive codebook, and a codebook for representing a sound source signal by a combination of a plurality of non-zero pulses and collectively quantizing amplitudes or polarities of the pulses when an output from said discrimination section indicates a predetermined mode, said sound source quantization section searching combinations of code vectors stored in said codebook and a plurality of shift amounts used to shift positions of the pulses so as to output a combination of a code vector and shift amount which minimizes distortion relative to input speech, and further including a multiplexer section for outputting a combination of an output from said spectrum parameter calculation section, an output from said adaptive codebook section, and an output from said sound source quantization section; and a speech decoding apparatus including at least:

a demultiplexer section for receiving and demultiplexing a spectrum parameter, a delay of an adaptive codebook, a quantized gain, and quantized sound source information, a mode discrimination section for discriminating a mode by using a past quantized gain in said adaptive codebook, a sound source signal reconstructing section for reconstructing a sound source signal by generating non-zero pulses from the quantized sound source information when an output from said discrimination indicates a predetermined mode, and a synthesis filter section which is constituted by spectrum parameters and reproduces a speech signal by filtering the sound source signal.

2. A speech coding/decoding apparatus comprising:

a speech coding apparatus including:

a spectrum parameter calculation section for receiving a speech signal, obtaining a spectrum parameter, and quantizing the spectrum parameter, an adaptive codebook section for obtaining a delay and a gain from a past quantized sound source signal by using an adaptive codebook, and obtaining a residue by predicting a speech signal, a sound source quantization section for quantizing a sound source signal of the speech signal by using the spectrum parameter and outputting the sound source signal, a discrimination section for discriminating a voice sound mode and an unvoiced sound mode on the basis of a past quantized gain of an adaptive codebook, and a codebook for representing a sound source signal by a combination of a plurality of non-zero pulses and collectively quantizing amplitudes or polarities of the pulses based on an output from said discrimination section, said sound source quantization section outputting a combination of a code vector and shift amount which minimizes distortion relative to input speech by generating positions of the pulses according to a predetermined rule, and further including a multiplexer section for outputting a combination of an output from said spectrum parameter calculation section, an output from said adaptive codebook section, and an output from said sound source quantization section; and a speech decoding apparatus including at least:

a demultiplexer section for receiving and demultiplexing a spectrum parameter, a delay of an adaptive codebook, a quantized gain, and quantized sound source information, a mode discrimination section for discriminating a mode by using a past quantized gain in said adaptive codebook, a sound source signal reconstructing section for reconstructing a sound source signal by generating positions of pulses according to a predetermined rule and generating amplitudes or polarities for the pulses from a code vector when an output from said discrimination section indicates a predetermined mode, and a synthesis filter section which includes spectrum parameters and reproduces a speech signal by filtering the sound source signal.

* * * * *